United States Patent [19]

Davies et al.

[11] 4,444,445

[45] Apr. 24, 1984

[54] APPARATUS INCLUDING ELECTRIC CURRENT TRANSFER

[75] Inventors: Evan J. Davies; Alec G. Allen, both of Sutton Coldfield, England

[73] Assignee: National Research Development Corporation, London, England

[21] Appl. No.: 341,183

[22] Filed: Jan. 20, 1982

[30] Foreign Application Priority Data

Jan. 26, 1981 [GB] United Kingdom ..... 8102313
Jun. 29, 1981 [GB] United Kingdom ..... 8119930

[51] Int. Cl.[3] ..... H01R 39/00
[52] U.S. Cl. ..... 339/5 M; 339/9 RY
[58] Field of Search ..... 339/5, 7, 6 R, 6 A, 339/6 RL, 8 R, 8 A, 8 P, 8 L, 8 PB, 8 PS, 8 RL, 9 RY, 61 M; 310/219, 231, 239, 248

[56] References Cited

U.S. PATENT DOCUMENTS 1,908,764 5/1933 Kruger ..... 339/8 R
2,236,707 4/1941 Darner et al. ..... 310/239
3,324,445 6/1967 Miller ..... 339/61 M

FOREIGN PATENT DOCUMENTS 513269 2/1955 Italy ..... 339/9 RY

*Primary Examiner*—Joseph H. McGlynn
*Assistant Examiner*—David L. Pirlot
*Attorney, Agent, or Firm*—Cushman, Darby & Cushman

[57] ABSTRACT

Apparatus consuming heavy electric current, such as an arc furnace, has concentric members (1) and (3) between which the current has to be transferred. The member (3) can rotate around, and/or move axially with respect to, member (1). Interposed, an annular member (2) has helically twisted tufts (11) of copper wire slidably retained by bushes (12) in a hole (10). The copper wires are compressed to fit between the members (1) and (3), and the compression is stored as elastic helical twisting energy, ensuring good contact pressure to transfer current between the members (1) and (3).

1 Claim, 3 Drawing Figures

APPARATUS INCLUDING ELECTRIC CURRENT TRANSFER

This invention relates to apparatus having two relatively movable conductive members between which electric current is to be transferred. Examples of types of apparatus which are envisaged are electrochemical plant, arc furnaces and induction heaters, where very heavy currents are handled and where a certain freedom of movement of current-carrying members during use is needed.

In apparatus according to the invention, the members have surfaces facing each other, their relative motion being such that the distance apart of the surfaces remains substantially the same (e.g. they are parallel plates, or they may be concentric and mutually rotatable or axially displaceable or both). In the invention, the surface of one of the members is characterized by a plurality of spaced resilient conductive bristles (e.g. of wire, or of tufts of wire) under pressure brushing the surface of the other member to effect the current transfer. The pressure is preferably accommodated elastically, preferably as a helical twist imparted to the tufts.

The tufts may be rooted in holes in the member.

The apparatus may consist of three concentric members. In this case, the middle one may be annular and bristled, further having spaced conductive bristles directed outwardly to brush an outermost (third) concentric conductive member mutually rotatable or axially displaceable or both with respect to the innermost (first) member, for current transfer between the first and the third members. The outwardly directed bristles may be rooted in through-holes and may be long enough to protrude such as simultaneously to serve as inwardly directed bristles.

Figure 1:
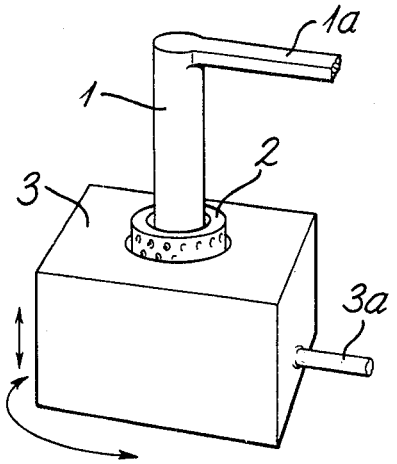
Figure 2:
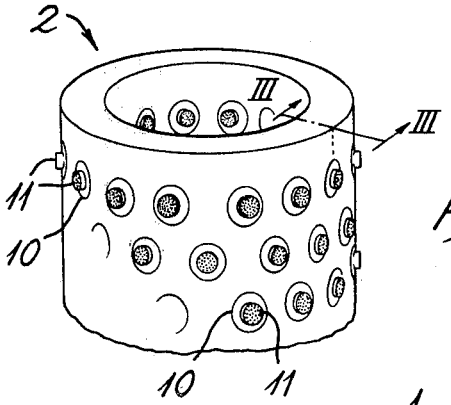
Figure 3:
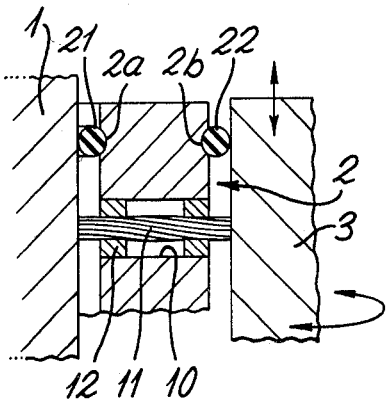

The invention will now be described by way of example with reference to the accompanying drawings, in which FIG. 1 shows schematically part of an apparatus according to the invention FIG. 2 shows one member of the apparatus to a larger scale and FIG. 3 is a section (to a still larger scale) taken in the vertical plane including the line III—III shown in FIG. 2, and showing the other members in position.

Turning to FIG. 1, a first member 1 is a copper column having a rigid radial arm 1*a* leading to a fixed supply of electricity.

A second member 2 is a non-magnetic annulus mounted concentrically on the column 1 with clearance and able to move axially and rotationally with respect to the first member 1. Preferably the annular gap between the members 1 and 2 is determined by non-conductive guide blocks (e.g. of nylon or PTFE) in the gap. A third conductive member 3 has a concentric space accommodating the second member 2 with clearance and has a rigid arm 3*a* leading to a moveable electrode arm of an arc furnace (not shown). When the electrode arm is moved, the third member 3 is thus forced to slide over and/or rotate about the second member 2. Movements of the electrode arm which cannot be accommodated by such sliding and rotation are not permitted. The return to the electricity supply would run to a fixed counter-electrode of the arc furnance. The second member 2 is not positively driven to move in any direction, but is freely left to take up inertly any position as the third member 3 is moved, subject to axial limit restraints, not shown, arranged so that the member 2 does not protrude out of the space between the first and third members.

As shown in more detail in FIG. 2, the second member 2 is an annulus having numerous radial bushed holes 10 in a regular array. In each hole 10, a bristle in the form of a tuft 11 of springy copper wire is held. The tuft 11 is square-cut at each end and slightly longer (when unstressed) than the distance from the outer surface of the first member 1 to the inner surface of the third member 3.

It will be appreciated that, if the member 3 were absent, the holes 10 need be only blind holes facing the first member 1, and the tufts slightly longer than the holes were deep plus the spacing between the members 1 and 2. In any case, the tufts could be conductively bonded in position, and each tuft could consist of a single wire only. An alternative material to copper would be, for example, phosphor bronze for its springiness.

FIG. 3 shows the three members in their relative operative positions, and one of the holes 10 in more detail. A bush 12 is force-fitted one at each end of the hole 10, flush with the body sides of the member 2. (Instead of one bush 12, the hole 10 could have been counterbored). The tuft 11, which is twisted elastically to form a long pitch helix or any other configuration giving axial springiness, is fitted to the illustrated postion by presenting it through both bushes 12. The tufts are a somewhat loose fit through the bushes. When the apparatus is assembled, the tufts 11 are necessarily compressed axially and relax partly by adjusting the pitch of their helix and partly by bowing-out in the central part of the hole 10 between the bushes 12; the helical form prevents excessive bowing-out.

When the apparatus is assembled, the numerous tufts 11 are held in position by compression between the members 1 and 3, while the member 2 is free to slide (either axially, subject to the limit restraints, or rotationally) relatively to either of those members.

Grooves 2*a* (inner) and 2*b* (outer) in the member 2 retain the previously mentioned guide blocks, shown as 21 and 22, for preserving the spacing between the members 1 and 2, and 2 and 3.

In use, heavy electric current (kiloamps or more) is to be transferred from the power supply to the arm 3*a*, which may have to move during passage of the current. (The expedient of water-cooled flexible cables to do this job is cumbersome and expensive). Current passes from the member 1 into the member 3 through the numerous tufts 11, such that any given wire is carrying only a modest current; should any wire be carrying excessive current, it will heat up and thus become more resistive, automatically forcing the total current to balance itself out better amongst all the wires.

The axial compression of the tufts 11, stored largely as a helix-twisting force, provides the contact pressure, and each individual wire can move along its own axis, even within a tuft, to adopt an equilibrium position to bear against both the members 1 and 3; of course the tuft as a whole can also move to adopt such an equilibrium position.

As the member 3 is moved, the tufts 11 (under their propensity to untwist and hence to lengthen) wipe the surface of the member 1 or of the member 3 or both, thus providing a self-cleaning action and automatically taking up slight wear or surface irregularities. Accordingly, no special conditions should be needed in the way of cooling gas or inert gas, except preferably for some rudimentary protection against gros dirt.

Which of the members 1 and 3 is moveable and which of them is connected to the power supply can be reversed compared with the illustrated example.

When the device is used as a connector, for example when the member 1 can be withdrawn completely and replaced as in the connections to an induction heater coil, it may be desirable to restrain the tufts 11 from excessive protrusion into the gap vacated by the member 1 but without interfering with their pressure function. A simple annular clip in association with the bushes 12 would suffice, such as a clip about the tuft 11 within the hole 10 and abutting the bush 12 nearer to the member 1, and there are many other ways of doing it.

Still when the device is used as a connector, a long lead chamfer can be provided on the member 1, so that on its reinsertion, it smoothly recompresses the tufts 11 which might otherwise obstruct it.

We claim:

1. Apparatus including first, second and third members, said first and third members being two mutually rotatable and axially displaceable concentric conductive members between which electric current is to be transferred, said first and said third members having surfaces facing each other and their relative motion being such that the distance apart of the surfaces remains substantially the same, said second member being an intermediate annular member which is concentric with said first and third members, said second, intermediate member having a plurality of spaced resilient tufts of wire disposed in substantially radially extending throughholes in said second member, said tufts being long enough to protrude both inwardly and outwardly thereof and the ends of said tufts thereby being under pressure and simultaneously brushing the facing surfaces of said first and third members to effect the current transfer, the pressure being accommodated elastically as a helical twist imparted to said tufts.

* * * * *